United States Patent [19]

Touzani

[11] Patent Number: 4,887,730

[45] Date of Patent: Dec. 19, 1989

[54] FRESHNESS AND TAMPER MONITORING CLOSURE

[76] Inventor: William Touzani, 1912 Bridgecreek Dr., Sacramento, Calif. 95833

[21] Appl. No.: 217,474

[22] Filed: Jul. 11, 1988

Related U.S. Application Data

[63] Continuation of Ser. No. 31,513, Mar. 27, 1987, abandoned.

[51] Int. Cl.[4] ..... B65D 41/04

[52] U.S. Cl. ..... 215/271; 215/1 C; 220/1 R

[58] Field of Search ..... 215/270, 271, 1 C; 150/55; 206/807; 220/85 B, 1 R; 116/270

[56] References Cited

U.S. PATENT DOCUMENTS 3,780,693 12/1973 Parr ..... 116/270
4,616,761 10/1986 Nolan ..... 215/271

FOREIGN PATENT DOCUMENTS 293596 10/1962 Australia ..... 150/55
1389226 1/1965 France ..... 220/85 B

*Primary Examiner*—Donald F. Norton
*Attorney, Agent, or Firm*—James M. Deimen

[57] ABSTRACT

A closure or cap for containers, bottles and jars having a circumferential groove formed by opposed conical surfaces of substantially equal size in the relaxed condition and upon compression of the closure forming a substantially toroidal circumferential groove. On a container sealed with the closure compressed, expansion of the circumferential groove to the relaxed condition indicates failure of the seal or generation of gases within the container. In an alternate embodiment the circumferential conical surfaces form a V-shaped circumferential protrusion in the relaxed condition and a toroidal protrusion in the compressed condition. In another embodiment the circumferential juncture between the conical surfaces and the closure sidewall is modified to reduce the flexure between the compressed and expanded conditions thereby permitting a wider variety of materials to be used for the closures. In a further modification the opposed conical surfaces are unequal in size and slope to the axis of the container to provide a partial latching action wherein a specified pressure differential is required to prevent unlatching of the opposed conical surfaces. In further embodiments single conical surfaces are adapted to specialized closure shapes and depending double conical surfaces to closures for carbonated beverages.

17 Claims, 2 Drawing Sheets

FRESHNESS AND TAMPER MONITORING CLOSURE

This is a continuation of co-pending application Ser. No. 07/031,513 filed on Mar. 27, 1987 now abandoned.

BACKGROUND OF THE INVENTION

The field of the invention pertains to closures for bottles, jars and other containers and, in particular, to caps for containers wherein a full or partial vacuum is to be maintained in the container until the cap is removed to obtain the contents. The field, however, is not limited to vacuum packaging but also includes containers wherein a partial vacuum can be maintained although the contents are not initially packed under partial vacuum conditions and carbonated beverages wherein the contents are packed under pressure.

Freshness and tamper monitoring of the contents of an unopened container continues to be of utmost importance in the packaging industry whether for food and consumer items or items related to health care. Means commonly used to indicate that the vacuum within a sealed container has not been lost or the contents have not spoiled include a cover with a depressed button area. With the loss of vacuum or the generation of gasses by noxious bacteria the depressed area will extend outwardly giving an obvious indication of possible danger.

With other containers such as cans, the lack of an audible inrush of air when the can is initially opened or the outward ejection of contents from the can when the can is initially opened indicate a failure of the sealing of the packaging or the generation of gasses by noxious bacteria.

Closures for containers, especially small closures such as bottle caps, do not readily indicate the failure of the seal despite the variety of means externally applied, such as shrink fit plastic wrappers to assure that the caps have not been removed. With the advent of plastic bottles, jars and other plastic packaging, one no longer can readily assure that freshness has been retained and that tampering has not occurred. Plastic bottles and jars permit tampering to be easily accomplished by means of a hypodermic needle or a razor slit along the mold parting line across the bottom of the bottle or jar.

With a view toward providing a cap or closure that more readily and obviously indicates a failure of the sealing of the container and a loss of freshness or possible tampering, the applicant has invented the closures disclosed below.

SUMMARY OF THE INVENTION

The basic invention is embodied in a closure or cap of substantially cylindrical configuration. Intermediate the cylindrical wall of the cap is a circumferential groove formed by opposed conical surfaces of substantially equal size in the relaxed condition. When attached to seal a container, the closure is compressed causing each of the conical sections to be curved in form and together to form a substantially toroidal groove just within the circumference of the cylindrical side wall. The compression of the closure causes potential energy to be stored in the curved conical sections in the manner of a compressed spring. The vacuum, partial vacuum or potential vacuum within the container causes external air pressure to retain the closure in the compressed condition unless the seal is broken whereupon the closure expands to the relaxed position exposing the two opposed conical sections and indicating failure of the seal.

In an alternate embodiment the opposed conical sections form an external circumferential protrusion about the cylindrical side wall of the closure. In the relaxed condition the two opposed sections are substantially conical. In the compressed and sealed condition the external protrusion forms a substantially toroidal ring about the cylindrical wall of the closure. With either embodiment failure of the container seal or the generation of gasses by noxious bacteria is made obvious to the viewer by expansion of the closure. Although described as equal conical sections, other surfaces of revolution in a mirror image configuration can be substituted as can surfaces that are not an exact surface of revolution.

In a second alternate embodiment the opposed conical surfaces are of unequal size to create a partial latching under the compressed condition whereby a minimum specified pressure differential is required to retain the conical surfaces compressed, folded and latched. Latching conical surfaces that fully overcenter and latch are disclosed in applicant's U.S. Pat. Re. No. 32379. As a freshness and tampering monitor, however, the hinging action at the fold rings defining the conical surfaces only store sufficient potential energy in the manner of a spring to release the latching and open the indicator or monitor when a specified minimum pressure differential is reached.

In general the cap or closure has a sidewall diameter substantially the same above and below the monitor or indicator and is generally circular (cylindrical) or oval although not limited to those shapes. In a third embodiment the upper and lower sidewall diameters differ substantially and a single conical sidewall combined with a modified fold ring is embodied in the closure to form the indicator. The potential energy is stored in the modified fold ring.

In a fourth embodiment the cap and indicator is directed specifically to pressurized contents although the above embodiments may be utilized for pressurized contents also. In the uncollapsed or relaxed condition the monitor forms a double cone defined by smaller and larger fold rings and located substantially within a container. The larger upper fold ring joins to a flange surrounding the upper cone. The flange is affixed and sealed to a container by a flat ring with a threaded skirt much like the closure of a canning jar. With carbonated or pressurized contents the double cone is bowed upward to substantially form a toroid retaining the stored potential energy of the monitor and is visible at the top of the container.

In additional alternative embodiments the junctures between the conical sections and sidewalls are modified to reduce the angular flexure at the junctures thereby permitting the use of a much wider variety of plastic and elastomeric materials for the closures. This modification for the closures is derived from applicant's pending U.S. Application Ser. No. 916,528 now U.S. Pat. No. 4,773,458 incorporated by reference herewith.

DESCRIPTION OF THE PREFERRED EMBODIMENTS

Figure 1:
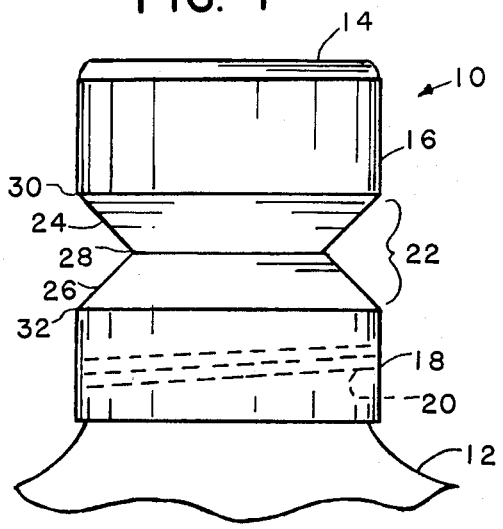
FIG. 1 is a side view of a cylindrical closure in relaxed condition.
Figure 2:
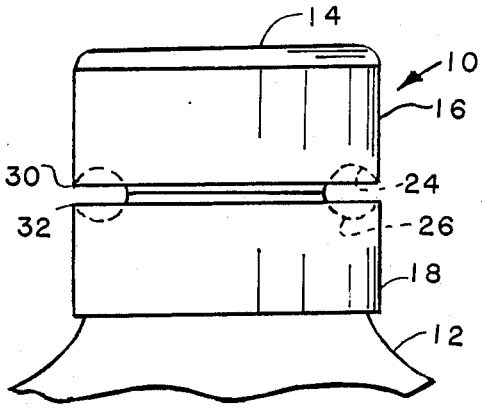
FIG. 2 is a side view of the cylindrical closure in compressed condition.

FIGS. 1 and 2 illustrate a container closure generally denoted by 10 attached to the top of a container 12 such as a bottle or jar. The attachment of the closure 10 to the container 12 may be by any conventional means such as a screw or a circumferential lip. The closure 10 comprises the top 14 and a cylindrical sidewall 16 integral with the top. The lower portion of the cylindrical sidewall 16 generally comprises a skirt area 18 formed with an internal lip or threaded 20 complementary to an external thread formed on the container 12.

Located between the skirt 18 and the top 14 is a circumferential groove 22 or bellow formed in the cylindrical sidewall 16. In the relaxed state the groove or bellow 22 comprises two opposed conical sections 24 and 26. The conical sections 24 and 26 are integrally joined at an inner fold ring 28. Each of the conical sections 24 and 26 joins the cylindrical sidewall 16 and skirt 18 with external fold rings 30 and 32 respectively.

In FIG. 2 the closure 10 is shown applied to a sealed container 12, the seal not having been broken. The closure 10 is compressed, foreshortening the overall cylindrical sidewall 16 and skirt 18 with the external fold rings 30 and 32 having been brought adjacent to each other as shown. In compressing the closure the internal fold ring 28 retains substantially the same diameter and the conical sidewalls 24 and 26 are distorted into a substantially semi-circular circumferential shape. Together the compressed conical sidewalls 24 and 26 form a substantially toroidal groove about the closure and open to the exterior through a circumferential gap between the external fold rings 30 and 32. The deformation of the conical sidewalls 24 and 26 stores potential energy therein releasable upon the removal of the pressure differential between the container contents and the environment.

The closure is retained in the compressed position by the vacuum or partial vacuum with the container 12. Thus, the ambient air pressure retains the closure compressed. If the seal is broken and the air tightness of the container 12 lost, or noxious gases are produced in the container, the pressure within the container will increase to equal or exceed the ambient air pressure. Thus, with the admittance of additional air or production of noxious gases, the closure can expand to the relaxed position of FIG. 1. Without sufficient air pressure inside the container, the closure cannot expand to the relaxed position. Thus, the failure of the container seal or the generation of gases by the contents of the container will be indicated visually by the closure in the expanded and relaxed position.

Figure 3:
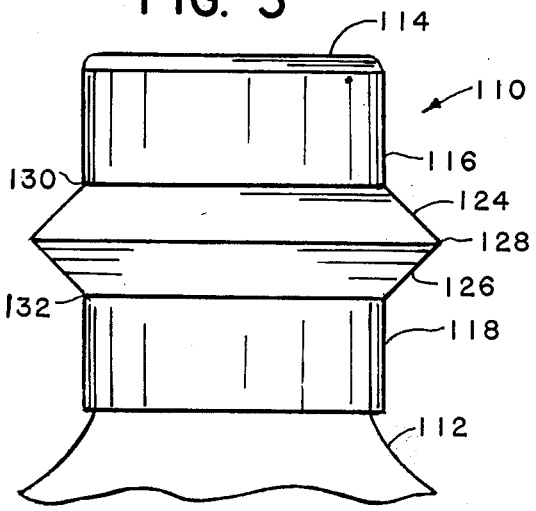
FIG. 3 is a side view of an alternative embodiment of the cylindrical closure.
Figure 4:
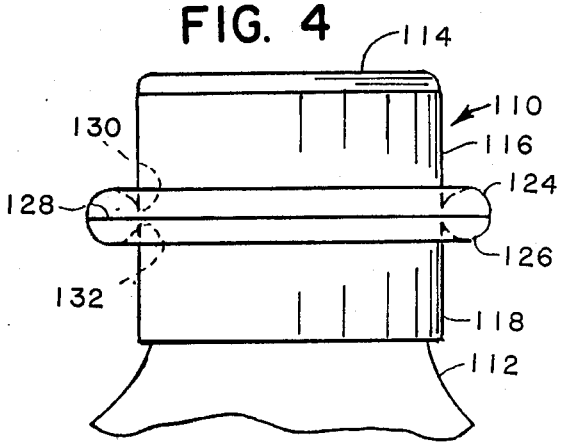
FIG. 4 is a side view of the closure of FIG. 3 in compressed condition.

FIGS. 3 and 4 illustrate an alternative embodiment of the freshness and tampering monitor. In FIGS. 3 and 4 the closure, generally indicated by 110, includes a top 114 and substantially cylindrical sidewall 116 and skirt 118. Intermediate the skirt 118 and top 114 is a circumferential protrusion comprising substantially conical upper 124 and lower 126 surfaces. Joined to the sidewall 116 by a circumferential fold ring at 130 is the conical upper surface 124. A second circumferential fold ring 132 joins the conical lower surface 126 to the skirt 118. The upper and lower conical surfaces 124 and 126 are blended together by an outside fold ring or area about the closure at 128. As above the skirt area 118 is adapted to be attached to a suitable container 112.

Compression of the closure as shown in FIG. 4 brings the external fold rings 132 and 130 adjacent each other, causing the circumferential protrusion formed by the conical surfaces 124 and 126 to take the roughly toroidal shape about the closure. The compressed condition is retained as above by the ambient air pressure acting upon the closure in response to the vacuum or partial vacuum within the container 112. Failure of the container seal or the generation of gases within the container will permit the internal pressure to balance or exceed the external pressure and the closure to expand to the relaxed condition of FIG. 3, thereby indicating the possibility of damage or contamination to the contents of the container.

The closures can be constructed of any material, in particular plastics, which can accommodate the angular flexure at the internal and external or outside fold rings. In particular, in FIGS. 1 and 2 a substantially severe angular deflection occurs at the external fold rings 30 and 32, while the flexing at the internal fold ring 28 is less severe. Similarly, the flexing at the ring junctures 130 and 132 of the alternate embodiment of FIGS. 3 and 4 is much more severe than the flexing at the outside ring area 128. Although single fold rings are shown at 28 and 128, a substantially cylindrical band may be substituted for the single fold rings and be joined with fold rings above and below to the pairs of conical sections. The deflection at each fold ring would thereby be substantially less with the cylindrical band and the conical sections would each be free to flex in either direction. The closures can be suitably constructed of materials such as polypropylene as disclosed in the above noted application of applicant. However, if more rigid materials must be employed, then the rings at 30 and 32 and 130 and 132 need to be modified in accordance with applicant's improved ring configurations of the above referenced application.

Figure 5A:
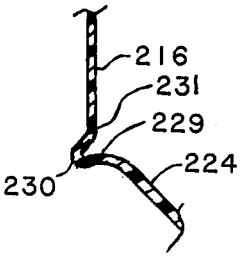
FIGS. 5*a* and 5*b* are partial sections showing an alternative configuration for the juncture of the conical sections and the side wall of the closure of FIG. 1.
Figure 5B:
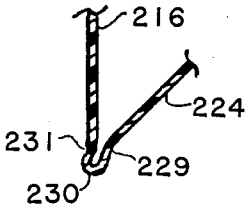

FIGS. 5 and 6 illustrate modifications to the fold rings to reduce the flexural angle that must be accommodated by the closure material. In FIGS. 5*a* and 5*b* the sidewall 216 is integrally joined to the conical surface 224 by an external fold ring 230. The fold ring at 230 is formed in the same manner as disclosed in applicant's above noted application to thereby limit the angular flexure at the fold ring 230 by providing a portion of the flexure in the curving approaches 229 and 231 to the fold ring 230. For example, the included angle at the fold ring 230 may be 10° or even 0° as is more fully explained in applicant's U.S. Pat. No. 4,773,458 noted above. With the curving approaches, much more rigid materials including light metals can be utilized for the closure.

Figure 6A:
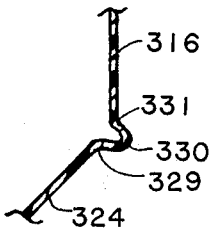
FIGS. 6*a* and 6*b* are partial cross-sections of another modification of the juncture between the conical sections of the closure of FIG. 1.
Figure 6B:
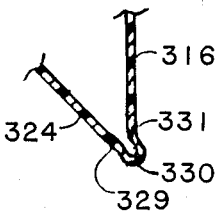

In the same manner, the externally protruding monitor sidewall 316 can be modified as shown in FIGS. 6*a* and 6*b* by an inward U-shape protrusion of the fold ring 330 and the curving approaches 329 and 331 to minimize the flexure at the fold ring 330. The selection of the material for the closure and the wall thickness and overall diameter of the closure will determine the necessity or not of the modifications of FIGS. 5 and 6. Most importantly, the material must be sufficiently resilient to retain stored mechanical energy in the conical sections, as deformed, for an indefinite period of time. Thus, a material that is highly creep resistant and otherwise resistant against the dissipation of stored mechanical energy is much prefered. Materials that relax to take on an impressed shape over a period of time would generally not be suitable.

However, a material with a predictable creep versus time function could be used as an indicator of excessive storage time. With such a creep predictable closure, the failure of the closure to expand to its relaxed position after removal from the container gives an immediate indication of excessive shelf time for the contents despite the retention of the seal until the closure was purposely removed.

Although the freshness and tamper monitoring means disclosed above is disclosed in terms of an improvement to a closure such as a top on a bottle or a jar, the circumferential groove or protrusion can be integrally formed in the sidewall of a plastic or light metal container. The freshness and tamper monitoring means is compressed as the container is filled and sealed and performs in the same manner as with the closure. The closures are described herein in terms of round shapes; however, the principles are applicable to oval or other shapes incorporating curved sidewalls.

Figure 7:
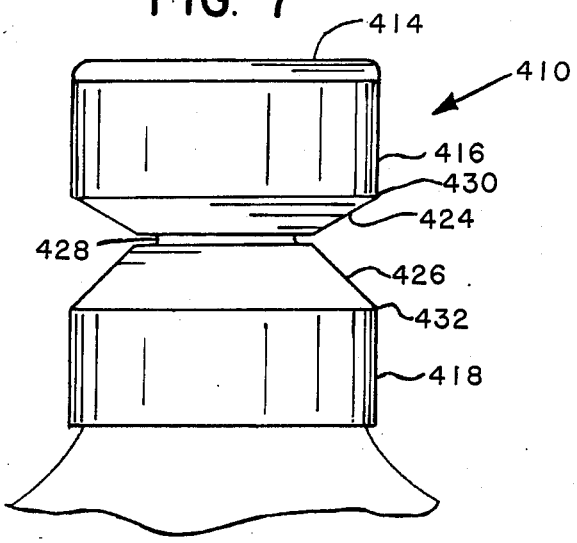
FIG. 7 is a side view of the second alternative embodiment showing a latching closure in relaxed condition.

In FIG. 7, the closure, generally denoted by 410, includes a top 414 and a cylindrical sidewall 416 integral with the top. A skirt area 418 may be suitably formed with means to attach to a container. Between the skirt 418 and sidewall 416 is a circumferential groove or bellow comprising two opposed unequal conical sidewalls or sections 424 and 426 respectively joined to the cylindrical sidewall 416 and skirt 418 by external fold rings 430 and 432.

Figure 8:
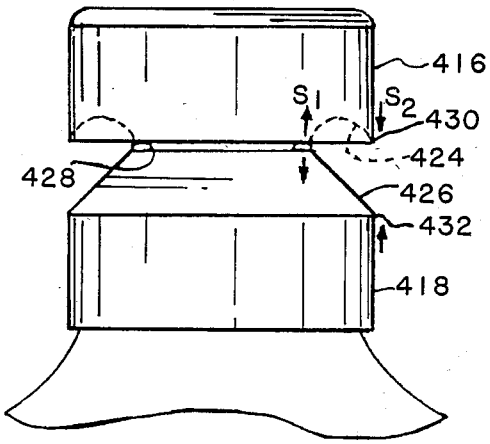
FIG. 8 is a side view of the closure of FIG. 7 at the intermediate overcentering condition.
Figure 9:
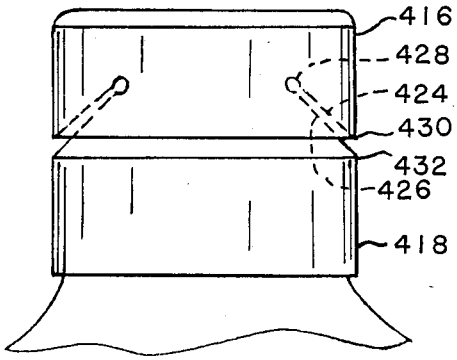
FIG. 9 is a side view of the closure of FIG. 7 in compressed condition.

Adjacent the inner fold ring 428 the included angle between the conical sidewalls 424 and 426 decreases as shown to ° from the included angle between the conical sidewalls at a substantial distance from the inner fold ring thus forming a groove at the inner fold ring. As the bellow is compressed beyond the overcentering point as shown in FIG. 8, the shorter conical sidewall 424 flexes and then straightens in reaching the latched position shown in FIG. 9. The areas of the conical sidewalls 424 and 426 immediately adjacent the inner fold ring 428, however, retain potential energy stored in the deformation adjacent the inner fold ring.

If the expansion force indicated by $S_1$ in FIG. 8 adjacent the inner fold ring 428 exceeds the retention force $S_2$ at the outer fold ring 430, the bellow will unlatch. Thus, the pressure differential between the contents in the container must be sufficient to overcome the deformation force adjacent the inner fold ring 428. A partial loss of vacuum thus can expand or relax the monitor or indicator and a full seal failure is not required to unlatch the monitor. In addition, the sudden full unlatching of the monitor gives a more obvious notice of slow failure once the minimum pressure differential is reached.

Figure 10:
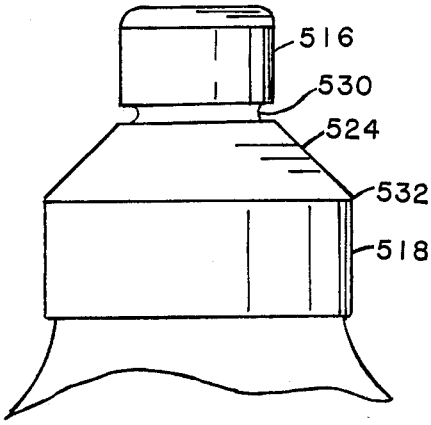
FIG. 10 is a side view of the third alternative embodiment showing a latching closure in relaxed condition.

In FIG. 10 the closure comprises a single conical sidewall 524 located between cylindrical sidewalls 516 and 518 of substantially different diameter. The cylindrical sidewalls 516 and 518 join the conical sidewall 524 with fold rings 530 and 532 respectively; however, the smaller fold ring 530 is formed with an included angle or U-shaped groove thereadjacent substantially less than the included angle between the sidewalls 516 and 524 at a substantial distance.

Figure 11:
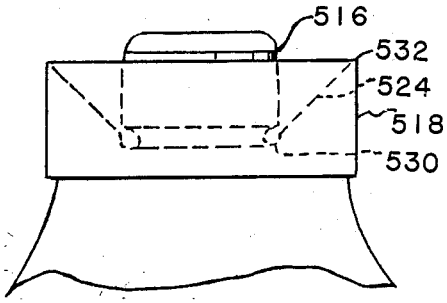
FIG. 11 is a side view of the closure of FIG. 10 in compressed condition.

As is shown in FIG. 11, the conical sidewall 524 flexes to overcenter in compressing to the condition in FIG. 11. As above, the U-shaped groove at 530 comprising the small included angle is deformed providing a restoring force to relax the closure upon insufficient pressure differential between the contents and the ambient air. In this embodiment, either cylindrical sidewall 516 or 518 can serve as the skirt with the opposite end enclosed to form a cap.

Figure 12:
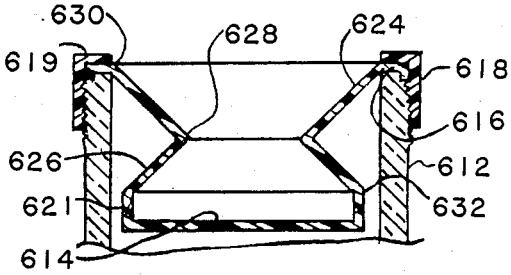
FIG. 12 is a partial section of the fourth alternative embodiment showing a carbonation cap in relaxed condition.

In FIG. 12, the closure comprises a pair of conical sidewalls 624 and 626 bounded by inner 628, upper 630 and lower 632 fold rings. Below the inner fold ring 628 is a disc 614 and cylindrical sidewall 618 to enclose and seal the center of the closure. Joined to the outer fold ring 630 is a flange 616 to seal the closure to the top of a container 612. Retaining the closure to the container is a second flange 619 attached to a skirt 618 which in turn is threaded or otherwise suitably attached to the container in a manner that tightly draws the flange 616 to the container.

Figure 13:
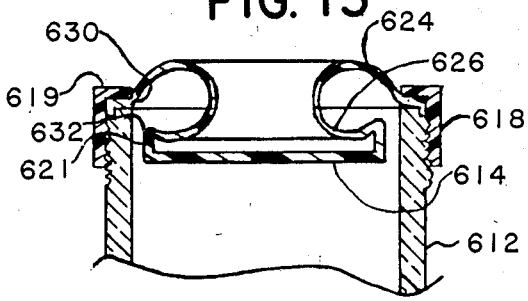
FIG. 13 is a partial section of the closure of FIG. 12 in pressurized or expanded condition.

The embodiment of FIG. 12 is intended for carbonated beverages and under the pressure within the container the conical sidewalls 624 and 626 are flexed upwardly to form a substantially toroidal shape as shown in FIG. 13. The toroidal shape is retained unless the internal pressure in the container is lost, permitting the closure to relax to the condition shown in FIG. 12.

In the embodiment of FIGS. 12 and 13 the freshness and tampering monitor is retained substantially within the aperture at the top of the container. Under carbonation pressure the monitor is clearly visible as shown. As one alternative, the monitor could be positioned lower in the container aperture by providing a depending cylindrical band between the flange 616 and upper fold ring 630. As another alternative the flange 616 may be integrally attached to the skirt 618 thus eliminating the separate skirt and flange.

Although the freshness and tamper monitoring indicator has been disclosed in terms of its application to a closure, the indicator can also be applied to the body of the container rather than the closure. By providing a single or pair of conical bellow sidewalls in the outside wall of the container and otherwise configured as above disclosed for the closures in FIGS. 1–4 and 7–11 the container wall can act as the monitor by showing collapse or expansion in the event of a failure of the sealing of the container and closure. Equal and unequal sided conical bellow sidewalls in a container wall are illustrated in applicant's two above noted patents.

I claim:

1. A freshness and tampering indicator forming a portion of a closed container having a wall and comprising, a circumferential pair of opposed conical sidewalls in the container wall forming a bellow in the relaxed state, said conical sidewalls extending to at least one fold ring, the fold ring between the conical sidewalls being spaced from the container wall, separate fold rings at the junctures of the conical sidewalls with the container wall, wherein the included angle between walls adjacent at least one fold ring differs from the included angle between the walls at a substantial distance from the fold ring.

2. The indicator of claim 1 wherein the included angle between the walls adjacent the fold ring is less than the included angle between the walls at a substantial distance from the fold ring.

3. The indicator of claim 1 wherein the included angle between the container wall and at least one conical sidewall adjacent the fold ring therebetween is less than the included angle between the container wall and said conical sidewall at a substantial distance from said fold ring therebetween.

4. The indicator of claim 1 wherein the included angle between the walls adjacent at least one fold ring is approximately 10° in uncollapsed condition.

5. The indicator of claim 1 wherein the included angle between the walls adjacent at least one fold ring is approximately 0° in uncollapsed condition.

6. A freshness and tampering indicator forming a portion of a closure and container having an outside wall and comprising, a circumferential pair of opposed conical sidewalls in the outside wall forming a bellow in the relaxed state, said conical sidewalls extending to at least one fold ring spaced from the outside wall and said conical sidewalls joined to the outside wall by fold rings, one of said conical sidewalls flexing from the relaxed to the compressed state to provide an overcentering of the bellow thereby providing a latching of the bellow, said latching of the bellow retained only when the fluid pressure inside the container and closure differs a prescribed amount from the outside fluid pressure.

7. The indicator of claim 6 wherein the included angle between walls adjacent at least one fold ring differs from the included angle between the walls at a substantial distance from said fold ring.

8. The indicator of claim 7 wherein the included angle between the walls adjacent at least one fold ring is approximately 10° in uncollapsed condition.

9. The indicator of claim 7 wherein the included angle between the walls adjacent at least one fold ring is approximately 0° in uncollapsed condition.

10. The indicator of claim 6 wherein the conical sidewalls differ in length and the shorter conical sidewall flexes to provide the overcentering.

11. The indicator of claim 6 wherein the conical sidewalls differ in slope and the lower slope sidewall flexes to provide the overcentering.

12. A freshness and tampering indicator forming a portion of a closure and container having an outside wall comprising, a circumferential conical sidewall forming a portion of the outside wall, a pair of fold rings joining the conical sidewall to the outside wall, said fold rings retaining substantially fixed diameters as said conical sidewall is flexed from the unfolded to the folded position wherein in said folded position the outside wall portions beyond the conical sidewall overlap.

13. The indicator of claim 12 wherein the included angle between the outside wall and sidewall adjacent at least one fold ring differs from the included angle between the outside wall and sidewall at a substantial distance from said fold ring.

14. The indicator of claim 13 wherein the included angle between the outside wall and the conical sidewall at said fold ring is less than the included angle between the outside wall and sidewall at a substantial distance from said fold ring.

15. The indicator of claim 13 wherein the included angle between the outside wall and the conical sidewall at said fold ring is approximately 10° in the unfolded position.

16. The indicator of claim 13 wherein the included angle between the outside wall and the conical sidewall at said fold ring is approximately 0° in unfolded position.

17. A collapsible freshness and tampering indicator comprising a substantially cylindrical sidewall and a top joined thereto, the improvement comprising at least a portion of said sidewall formed into at least one conical section extending therearound, said conical section joined by fold rings to the sidewall, and said fold rings retaining substantially fixed diameters and said conical section flexing from the unfolded to the folded position to provide an overcentering of the conical section during folding thereby latching the conical section in the collapsed position.

* * * * *